US008550580B2

(12) United States Patent
Shimoda et al.

(10) Patent No.: US 8,550,580 B2
(45) Date of Patent: Oct. 8, 2013

(54) INKJET IMAGE FORMING APPARATUS

(75) Inventors: Tomohiko Shimoda, Ibaraki-ken (JP); Ryo Terakado, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 183 days.

(21) Appl. No.: 13/281,498

(22) Filed: Oct. 26, 2011

(65) Prior Publication Data

US 2012/0105520 A1 May 3, 2012

(30) Foreign Application Priority Data

Oct. 27, 2010 (JP) ..... P2010-240979

(51) Int. Cl.
*B41J 29/38* (2006.01)
*B41J 2/195* (2006.01)
*B41J 2/18* (2006.01)

(52) U.S. Cl.
USPC ..... 347/6; 347/7; 347/89

(58) Field of Classification Search
USPC ..... 347/6–7, 89
See application file for complete search history.

(56) References Cited

U.S. PATENT DOCUMENTS 6,935,729 B2 * 8/2005 De Marco et al. ..... 347/73
8,215,017 B2 * 7/2012 Hayashi ..... 29/890.1

FOREIGN PATENT DOCUMENTS

JP 2004-188857 A 7/2004

* cited by examiner

*Primary Examiner* — Jason Uhlenhake
(74) *Attorney, Agent, or Firm* — Nath, Goldberg & Meyer; Jerald L. Meyer; Scott C. Langford

(57) ABSTRACT

An inkjet image forming apparatus includes print heads, a first tank, an ink circulation line, and a controller. The ink circulation line includes an ink supply line for supplying ink from the first tank to the print heads, and an ink return line for returning ink collected from the print heads to a second tank. The controller controls line elements of the ink circulation line, to adjust a magnitude relation between a first product and a second product, in accordance with the type of ink. The first product is a product of factors including a flow passage length along, a viscosity of ink in, and a fluid resistance coefficient of the ink supply line. The second product is a product of factors including a flow passage length along, a viscosity of ink in, and a fluid resistance coefficient of the ink return line.

7 Claims, 13 Drawing Sheets

FIG. 10A

DETERMINATION TABLE 1

| | | SUSPENSION | | | | | | |
|---|---|---|---|---|---|---|---|---|
| | | UNDER 336 HOURS (2 WEEKS) | | | | | | 336 HOURS (2 WEEKS) OR MORE |
| | | TEMPERATURES [°C] | | | | | | |
| | | 6 | 10 | 14 | 18 | 22 | 26 | |
| VISCOSITIES [mPa·s] | 5 | ○ | ○ | ○ | ○ | ○ | ○ | ▲ |
| | 10 | ○ | ○ | ○ | ○ | ○ | ○ | |
| | 15 | ○ | ○ | ○ | ○ | ○ | ○ | |
| | 20 | ○ | ○ | ○ | ○ | ○ | ○ | |
| | 25 | ○ | ○ | ○ | ○ | ○ | ○ | |
| | 30 | ○ | ○ | ○ | ○ | ○ | ○ | |
| | 35 | ○ | ○ | ○ | ▲ | ▲ | ▲ | |
| | 40 | ○ | ○ | ▲ | ▲ | ▲ | ▲ | |
| | 45 | ○ | ▲ | ▲ | ▲ | ▲ | ▲ | |
| | 50 | ▲ | ▲ | ▲ | ▲ | ▲ | ▲ | |
| | 55 | ▲ | ▲ | ▲ | ▲ | ▲ | ▲ | |

○ : CIRCULATION
▲ : PURGE

FIG. 10B

DETERMINATION TABLE 2

| | | TEMPERATURES [°C] | | | | | |
|---|---|---|---|---|---|---|---|
| | | 6 | 10 | 14 | 18 | 22 | 26 |
| VISCOSITIES [mPa·s] | 5 | ▲ | ▲ | ▲ | ▲ | ▲ | ▲ |
| | 10 | ▲ | ▲ | ▲ | ▲ | ▲ | ▲ |
| | 15 | ▲ | ▲ | ▲ | ▲ | ▲ | ▲ |
| | 20 | ▲ | ▲ | ▲ | ▲ | ▲ | ▲ |
| | 25 | ▲ | ▲ | ▲ | ▲ | ▲ | ▲ |
| | 30 | ▲ | ▲ | ▲ | ▲ | ▲ | ▲ |
| | 35 | ☆ | ☆ | ☆ | ☆ | ☆ | ☆ |
| | 40 | ☆ | ☆ | ☆ | ☆ | ☆ | ☆ |
| | 45 | ☆ | ☆ | ☆ | ☆ | ☆ | ☆ |
| | 50 | ☆ | ☆ | ☆ | ☆ | ☆ | ☆ |
| | 55 | ☆ | ☆ | ☆ | ☆ | ☆ | ☆ |

▲ : PURGE
☆ : CONTINUED WARM-UP

| FLOW RATES | BEFORE WARM-UP | AFTER WARM-UP |
|---|---|---|
| $u_{total}$ | 58.2 | 71.5 |
| u1 | 11.3 | 17.9 |
| u2 | 10.8 | 17.4 |
| u3 | 9.4 | 9.4 |
| u4 | 9.1 | 9.1 |
| u5 | 8.8 | 8.8 |
| u6 | 8.9 | 8.9 |

INKJET IMAGE FORMING APPARATUS

BACKGROUND OF THE INVENTION

1. Technical Field

The present invention relates to an inkjet image forming apparatus, and particularly, to an inkjet image forming apparatus employing an ink circulation system that circulates an ink through a print head.

2. Background Arts

There are inkjet printers capable of high-speed color printing, costing low. They are remarkably widespread. Most types of inkjet printers are connectable to a terminal, such as a personal computer, to take in image data, such as letters, illustrations and marks, produced at the terminal, and print the image data on a sheet. Composite types of inkjet printers have an integrated scanner or facsimile to take in image data through the scanner and print them; or to receive image data transferred to the facsimile and print them.

Some types of inkjet printers are likely to use a high-viscous ink to prevent sheets from being stained with ink. This is to enhance the quality of print image. Using such an ink permits the print image quality to be enhanced. However, high-viscous inks tend to stagnate in a flow passage. Some types of ink might be unlikely to flow in inkjet printers employing an ink supply system in which the ink used runs down by own weight, as discussed in the Japanese Patent Application Laid-Open Publication No. 2004-188857. Using such an ink might constitute a difficulty for ink supply to be smooth all the way from an ink storage section to a print head, as an issue.

The Patent Literature has disclosed an inkjet printer including an intermediate ink storage portion between the ink storage section and the print head. The intermediate ink storage portion has a pressure retaining mechanism to retain pressures acting on a liquid level of stored ink within an atmospheric pressure range. This inkjet printer is adapted to supply ink from the intermediate ink storage portion to the print head with an even pressure, as a solution to the issue above.

On the other hand, inkjet printers are given a prescribed temperature range. This is to ensure the performance that a type of ink used for the printing should have to attain a favorable printing result. There are inkjet printers employing an ink circulation system to be effective to ensure the performance of ink. This system always circulates an ink, unlike the system in which an ink runs down by own weight. In that system, the ink being circulated can be controlled within a prescribed temperature range.

Such inkjet printers include a print head, an ink storage tank, and an ink circulation line provided with a heater for heating ink flowing in the ink circulation line, and a cooler for cooling ink flowing in the ink circulation line. The ink circulation line has an ink supply line for supplying a flux of ink from the ink storage tank to the print head, and an ink return line for returning fluxes of ink collected from the print head to the tank. The ink temperature may become too low, deviating from a temperature range ensuring a performance of ink. In such situations, the heater is operated to heat the ink. Also, the ink temperature may become too high, deviating from the temperature range ensuring the performance of ink. In such situations, the cooler is operated to cool the ink. Inkjet printers employing such an ink circulation system are adapted to use a combination of a heater and a cooler to control an ink temperature. It therefore is possible to make use of a performance of ink to a maximum degree, with a favorable printing result allowing for an enhanced print image quality.

SUMMARY OF THE INVENTION

However, inkjet printers employing ink circulation systems in the past lacked consideration for the following points. Among inkjet printers employing ink circulation systems, those using such a high-viscous ink as discussed in the Patent Literature undergo large differences caused in viscosity of ink by variations in ink temperature. If an ink supply line and an ink return line in an ink circulation line have their ink temperatures varied to be different in between, ink discharge nozzles at a print head undergo variations of pressures acting thereon. Such variations cause leakage of ink or suction of air. If ink leakage occurs, consumed ink involves wasted ink. If air suction occurs, the print image quality becomes degraded.

The present invention has been devised in view of such issues. It therefore is an object of the present invention to provide an inkjet image forming apparatus employing an ink circulation system. The inkjet image forming apparatus is adapted to suppress ink leakage, reduce useless ink consumption, and suppress air suction, to enhance the print image quality.

As a solution to achieve the object, according to a first aspect of embodiment of the present invention, there is provided an inkjet image forming apparatus including an inkjet print head, an ink tank adapted to store a prescribed type of ink, an ink circulation line, and a controller. The ink circulation line includes an ink supply line configured to supply ink from the ink tank to the print head and an ink return line configured to return ink from the print head to the ink tank. The controller is configured to adjust a first product of factors including a flow passage length along the ink supply line, a viscosity of ink in the ink supply line, and a fluid resistance coefficient of the ink supply line, and a second product of factors including a flow passage length along the ink return line, a viscosity of ink in the ink return line, and a fluid resistance coefficient of the ink return line. This adjustment is made in accordance with the type of ink to control temperatures of ink in the ink circulation line.

BRIEF DESCRIPTION OF THE DRAWINGS

FIG. 10A and FIG. 10B are diagrams representing determination tables to be used for operations of the ink circulation system of the inkjet image forming apparatus according to the second embodiment.

DESCRIPTION OF THE EMBODIMENTS

Figure 1:
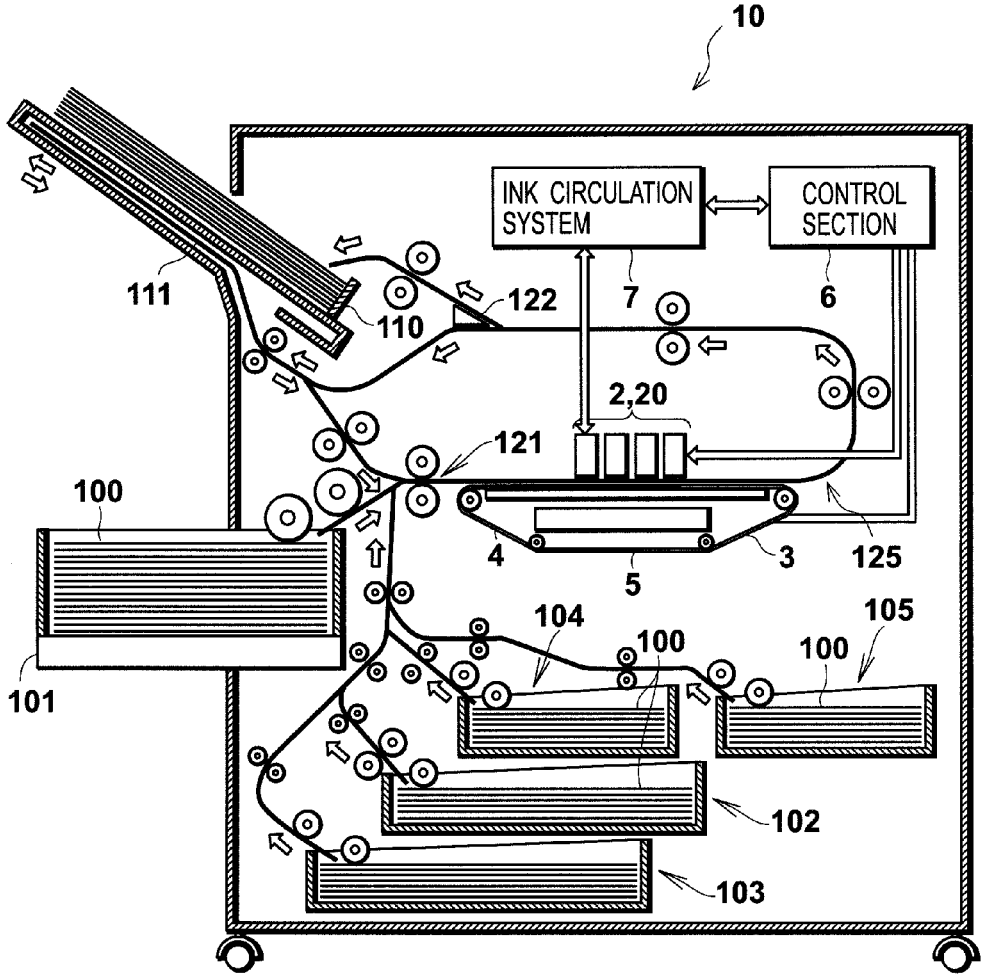
FIG. 1 is a schematic diagram of a printer mechanism of an inkjet image forming apparatus according to a first embodiment of the present invention.

There will be described embodiments of the present invention with reference to the drawings. In the drawings, the same or similar parts are designated at the same or similar reference signs. It is noted that drawings show what is typical, not real.

The embodiments to be described are illustrative to show specific apparatuses or methods implementing a technical concept according to this invention. The technical concept of this invention does not restrict arrangements of components or the like to what is described below. The technical concept of this invention can be modified in various manners within the scope of claims.

First Embodiment

The first embodiment of the present invention describes an example of the present invention applied to a color inkjet image forming apparatus that employs a set of ink circulation systems. It is noted that description of this embodiment as well as subsequent embodiments will be made simply of an ink circulation system for a single color of ink, a black ink in this case, for easy understanding. For ink circulation systems for other colors, more specifically, for cyan, magenta, and yellow inks, their description will be omitted, as similar configurations are employed in the inkjet image forming apparatus. That is, the color inkjet image forming apparatus has four ink circulation systems incorporated therein for the four colors of ink to be independently circulated. It is also noted that the present invention is applicable not simply to color inkjet image forming apparatuses, but also to inkjet image forming apparatuses for forming monochrome images including gray scaled images.

[Configuration of Inkjet Image Forming Apparatus]

FIG. 1 shows an inkjet image forming apparatus 10 employing an ink circulation system according to the first embodiment. The inkjet image forming apparatus 10 includes a sheet transfer system 125 adapted to feed a print sheet 100, serve to have the sheet printed, and discharge the printed sheet. The inkjet image forming apparatus 10 is provided with a machine housing that has, at the left lateral side given no reference signs, a sheet feed rack 101 detachably attached thereto, and projected outside the machine housing. The machine housing has therein several sheet feed trays 102, 103, 104, and 105. The feed rack 101, as well as each feed tray 102 to 105, is adapted to store therein a set of unprinted sheets (prepared for print). The inkjet image forming apparatus 10 has a sheet mount rack 110 disposed at an upper left section of the machine housing. The mount rack 110 is adapted to receive printed sheets discharged thereon (after print).

The inkjet image forming apparatus 10 includes a print head assembly 20 composed of an array of print heads 2. Each print head 2 has a multiplicity of ink discharge nozzles arrayed in a perpendicular direction to the transfer direction of a sheet fed e.g. from the feed rack 101. Each print head 2 is operative to propel out droplets of black ink, cyan ink, magenta ink, or yellow ink, to make a print in a unit of line. The inkjet image forming apparatus 10 according to the first embodiment is adapted to serve as a color inkjet image forming apparatus employing an ink circulation system.

The inkjet image forming apparatus 10 according to the first embodiment includes a control section 6, and an ink circulation system 7. The ink circulation system 7 will be detailed later on. The control section 6 governs the most systems in the inkjet image forming apparatus 10, covering the sheet transfer system and the ink circulation system 7. The control section 6 includes a central processing unit (CPU), and a memory, as will de described later on. The CPU is adapted to control operations of the systems above, in accordance with input data. The input data may involve detection data from sensors, and operational data from an operation panel and one or more external terminals (e.g. personal computers). The memory has programs stored therein to be processed at the CPU to control operations of associated systems.

It is noted that application of the inkjet image forming apparatus 10 according to the first embodiment is not simply restricted to systems making a print in a unit of line. For instance, it may cover also serial systems scanning in a line direction to make a print.

[Printing Operations of the Inkjet Image Forming Apparatus]

The inkjet image forming apparatus 10 shown in FIG. 1 can make printing operations, under control of the control section 6, as follows. First, an unprinted sheet is fed from the feed rack 101 or any one of feed trays 102 to 105. This sheet is transferred by drive mechanisms, which are made up by rollers or the like given no specific reference signs, along a transfer route in a sheet feed system in the machine housing. The sheet is led to a register section 121. The register section 121 has functions of positioning a transferred sheet, at the front edge in the feed direction, making a correction to avoid oblique travels, etc. The register section 121 includes a pair of register rollers opposing each other in a direction perpendicular to the transfer route in the feed system. The sheet transferred to the register section 121 is once stopped there, and afterward, it is transferred at a prescribed timing to the print head assembly 20 (as a printing section) in which the print heads 2 are arrayed.

There is a spatial region opposing the array of print heads 2, with the feed system's transfer route intervening in between. This region has a looped transfer belt 3, a platen plate 4, and a suction device 5 accommodated therein. The transfer belt 3 is configured to travel on the platen plate 4 at a speed depending on a given printing condition, to carry a sheet. This sheet is suctioned by the suction device 5, through non-depicted belt-through holes of the transfer belt 3 and non-depicted suction holes of the platen plate 4. The sheet is suctioned onto a surface of the transfer belt 3, as necessary to carry. The transfer belt 3 is thus used for transfer of a sheet. The print heads 2 are operable to propel out droplets of ink of different colors, onto the sheet being transferred, to make thereon a color print, a monochrome print, or a gray scale print.

A printed sheet is transferred by drive mechanisms along a transfer route in a sheet discharge system. For one-side printing, the sheet is lead as it is transferred to discharge onto the mount rack 110. For both-side printing, the sheet as one-side printed is lead from the transfer route in the discharge system, through a switching mechanism 122, to a switchback route 111. This sheet has a reversed side to be printed, to return to a transfer route in the feed system. The sheet as returned to the feed system's transfer route is transferred from the register section 121 to the print head assembly 20, where it is printed. Afterward, the printed sheet is transferred along the discharge system's transfer route to discharge onto the mount rack 110, like the case of one-side printing.

[Configuration of the Ink Circulation System]

Figure 2:
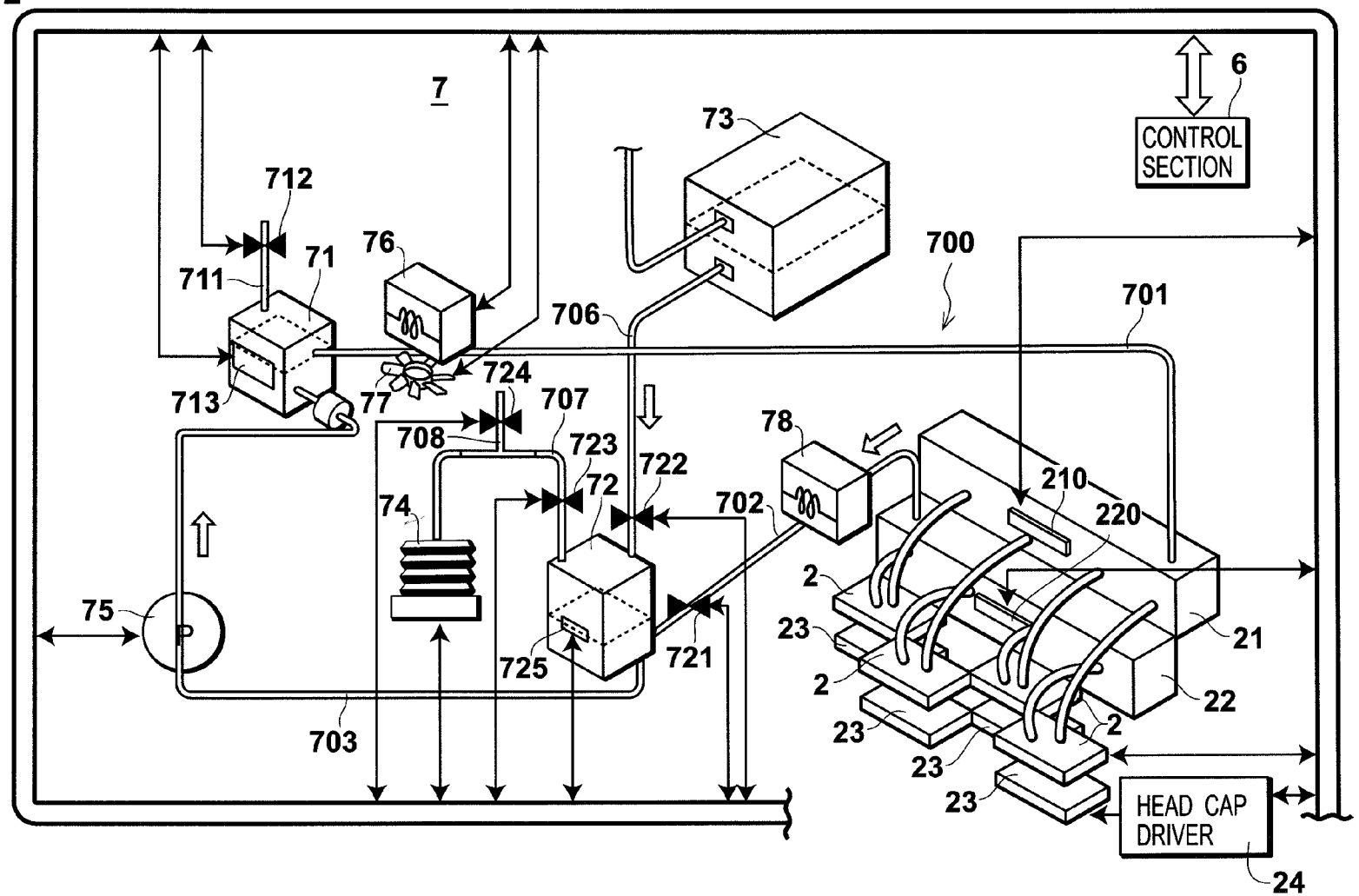
FIG. 2 is a configuration diagram of an ink circulation system of the inkjet image forming apparatus according to the first embodiment.

The inkjet image forming apparatus 10 according to the first embodiment includes an ink circulation system 7 shown in FIG. 2. The ink circulation system 7 includes the array of inkjet print heads 2, a combination of a first ink tank (as an upstream tank or a first sub-tank) 71 and a second ink tank (as a downstream tank or a second sub-tank) 72, and an ink circulation line 700. The array of inkjet print heads 2 has been described with reference to FIG. 1. The first tank 71 can serve to store therein a prescribed type of ink being used in the ink circulation system 7. The second tank 72 can serve to store therein incoming ink. The ink circulation line 700 includes an ink supply line 701 for supplying ink from the first tank 71 to the array of print heads 2, and a first ink return line 702 for returning ink collected from inside the array of print heads 2, up to the second tank 72. It is noted that the ink circulation line 700 has interior spaces of the first tank 71, the second tank 72, and the array of print heads 2, as parts thereof. The control section 6 calculates a below-described first product for the ink supply line 701, and a below-described second product for the ink return line 702. The first product is a product of factors (shown in FIG. 3) including a flow passage length L1 along, a viscosity $\eta 1(t)$ of ink in, and a fluid resistance coefficient K1 of the ink supply line 701. The second product is a product of factors (shown in FIG. 3) including a flow passage length L2 along, a viscosity $\eta 2(t)$ of ink in, and a fluid resistance coefficient K2 of the ink return line 702. The control section 6 is configured to make adjustments of the first and second products in accordance with the type of ink, to control temperatures of ink in the ink circulation line 700. More specifically, the control section 6 controls later-described line elements of the ink circulation line 700, for cooperation therewith to constitute a later-detailed ink temperature control system. The ink temperature control system serves (as an ink temperature controller) for controlling temperatures of ink in the ink circulation line 700. The control section 6 is adapted to adjust a magnitude relation between the first product and the second product in accordance with the type of ink (whether it is an aqueous type or an oily type). In this embodiment, the control section 6 is adapted to adjust the second product to be equal to or larger than the first product.

In addition, the inkjet image forming apparatus 10 includes an inkbottle 73 for storing the same type of ink as above, to supplement the second tank 72 with the ink. The ink circulation line 700 includes a second ink return line 703 for returning ink from the second tank 72 to the first tank 71. The ink circulation line 700 has, as line elements thereof, a pressure controller 74, an ink circulation pump 75, a first heater 76, a cooler 77, a second heater 78, etc. The pressure controller 74 is operatively connected to the second tank 72. The ink circulation pump 75 is installed on the second ink return line 703. The first heater 76 and the cooler 77 are installed on the ink supply line 701. The second heater 78 is installed on the first ink return line 702.

At the second tank 72, a flux of ink returned thereto or supplemented from the inkbottle 73 is stored. A flux of ink stored in the second tank 72 is returned through the second ink return line 703 to the first tank 71, where it is stored. At the second ink return line 703, ink is forced to flow by the ink circulation pump 75. The first tank 71 has an atmosphere release line 711 connected thereto. The atmosphere release line 711 has an atmosphere release valve 712 installed thereon as a line element of the ink circulation line 700. The atmosphere release valve 712 is controlled to open or close by the control section 6. The pressure of ink to be supplied from the first tank 71 is controlled in accordance with an open-close operation of the atmosphere release valve 712. The first tank 71 is thus adapted to hold constant the flow rate and pressure of ink to be supplied to the array of print heads 2. The ink supply line 701 is connected at one end thereof to the first tank 71, and at the other end thereof to the array of print heads 2, through an ink distributor 21.

The first tank 71 has a first level sensor 713 as a line element of the ink circulation line 700 for detecting a liquid level of ink stored therein. The control section 6 is connected through a signal line to the first level sensor 713, and can use the first level sensor 713 to detect an upper limit in quantity of ink stored in the first tank 71.

The ink distributor 21 is configured to evenly distribute ink supplied from the first tank 71 through the ink supply line 701 to the array of print heads 2. The ink distributor 21 is installed just upstream of the array of print heads 2, to supply ink to the array of print heads 2. In this sense, the ink distributor 21 constitutes part of the ink supply line 701 in the ink circulation line 700.

The first ink return line 702 is connected at one end thereof to the array of print heads 2, through an ink collector 22, and at the other end thereof to the second tank 72. The ink collector 22 is configured to collect surplus ink unused at the array of print heads 2, to return to the second tank 72. The ink collector 22 is installed just downstream of the array of print heads 2, to collect ink from inside the array of print heads 2. In this sense, the ink collector 22 constitutes part of the first ink return line 702 in the ink circulation line 700.

In the first embodiment, the ink distributor 21 is provided with a thermometer (as a temperature sensor) 210 for measuring a most effective temperature of ink just before the use for a printing. An ink temperature measured by the thermometer 210 is sent to the control section 6. Also, the ink collector 22 is provided with a thermometer (as a temperature sensor) 220 for measuring a most effective temperature of ink just after the use for a printing. An ink temperature measured by the thermometer 220 is sent to the control section 6.

The array of nozzle heads 2 has head caps 23 disposed as line elements of the ink circulation line 700 on the side of nozzle headers thereof in which ink discharge nozzles are arrayed. The head caps 23 are driven by a head cap driver 24. The head cap driver 24 is controlled by the control section 6. The head caps 23 are configured to be driven to block the nozzle headers of print heads 2, as necessary, to stop propelling out droplets of ink. When the nozzle headers are blocked, associated interior spaces of the ink supply line 701 and the ink return line 702 are closed relative to the outside. The head caps 23 are driven by the head cap driver 24 in accordance with a control signal from the control section 6.

The array of print heads 2 has ink unused for any printing, which is collected as surplus ink to store in the second tank 72. The first ink return line 702 has, at the above-noted other end, an open-close valve 721 installed thereon as a line element of the ink circulation line 700 and controlled to open and close by the control section 6. The second tank 72 is connected through a pressure control line 707 to a pressure controller 74. The pressure controller 74 is provided as a line element of the ink circulation line 700 for controlling a gas pressure to thereby control an ink pressure in the second tank 72. In the first embodiment, the pressure controller 74 is configured as a bellows to be expanded and contracted to provide increased and decreased pressures, allowing for a reduced fabrication cost with a facilitated structure. It is noted that the pressure controller 74 is not always limited to this configuration. The pressure controller 74 is connected through a signal line to the control section 6, so that it is operable for pressure adjustment with a control signal from the control section 6. The pressure controller 74 is adapted to mainly serve as a negative pressure regulator to exert an adequate negative pressure on fluxes of ink in the array of print heads 2. The pressure control line 707 has, at a proximal end thereof, an open-close valve 723 installed thereon as a line element of the ink circulation line 700 and controlled to open and close by the control section 6. The pressure control line 707 is branched to provide an atmosphere release line 708 at an intermediate section thereof. The atmosphere release line 708 has an atmosphere release valve 724 installed thereon as a line element of the ink circulation line 700. The atmosphere release valve 712 is controlled to open or close by the control section 6. The second tank 71 is thus adapted to hold constant the flow rate and pressure (negative pressure in this case) of ink to be circulated, substantially like the first tank 71.

The second tank 72 has a second level sensor 725 as a line element of the ink circulation line 700 for detecting a liquid level of ink stored therein. The control section 6 is connected through a signal line to the second level sensor 725, and can use the second level sensor 725 to detect an upper limit in quantity of ink stored in the second tank 72.

The second tank 72 is connected to the inkbottle 73 through an ink supplement line 706. The ink supplement line 706 has a supplemental flow control valve 722 installed thereon as a line element of the ink circulation line 700 and controlled to open and close by the control section 6. The inkbottle 73 is configured to operate, when a circulating ink flow is reduced, to supplement the ink flow.

The first heater 76 as well as the cooler 77 is installed on the ink supply line 701, along a section of the ink supply line 701 near to the first tank 71 in this case. The first heater 76 as well as the cooler 77 is configured to adjust an ink temperature to be adequate to attain a favorable printing. In the first embodiment, a thermoelectric heater is employed as the first heater 76. For the cooler 77, there is employed a set of cooling fins for reducing temperatures of ink by way of heat exchange, in combination with a set of cooling fans for reducing temperatures of ink by drawing hot air or blowing cold air.

The second heater 78 is installed along a section of the first ink return line 702. The second heater 78 is configured to adjust an ink temperature to be adequate to attain a favorable printing. In the first embodiment, a thermoelectric heater is employed as the second heater 78, like the case of the first heater 76.

In the ink circulation system 7 according to the first embodiment, the ink circulation line 700 includes the first tank 71, the ink supply line 701 with the ink distributor 21 inclusive, the array of print heads 2, the first ink return line 702 with the ink collector 22 inclusive, the second tank 72, and the second ink return line 703 with the ink circulation pump 75 inclusive.

FIG. 2 shows the ink circulation system 7 for a single color. According to the first embodiment, the inkjet image forming apparatus 10 is provided as a color inkjet image forming apparatus that further includes three other ink circulation systems 7 non-depicted but similar in configuration. Accordingly, the inkjet image forming apparatus 10 has four ink circulation systems 7 incorporated therein, in total.

[Circulation of Ink in the Ink Circulation System]

In the entirety of ink circulation system 7 shown in FIG. 2, ink is circulated as follows.

First, stored ink in the first tank 71 is supplied through the ink supply line 701 and the ink distributor 21 to the array of print heads 2. In the way from the first tank 71 through the ink supply line 701 to the array of print heads 2, ink is controlled by the first heater 76 and the cooler 77 to a temperature within a range to be adequate to attain a favorable printing.

At the array of ink heads 2, supplied ink is consumed as necessary to make a print on a sheet. Surplus ink unused for the printing is collected through the ink collector 22. Collected ink is lead through the first ink return line 702 to flow into the second tank 72, where it is stored. Stored ink in the second tank 72 is forced to return to the first tank through the second ink return line 703 including the ink circulation pump 75. At the first tank 71, returned ink from the second ink return line 703 is stored therein to again supply to the array of print heads 2.

Here, an ink temperature is measured by either one or each of the thermometer 210 at the ink distributor 21 and the thermometer 220 at the ink collector 22. If the ink temperature is too low to attain a favorable printing, the control section 6 drives the first heater 76 to heat ink to be circulated. If the ink temperature is too high to attain a favorable printing, either, the control section 6 drives the cooler 77 to cool ink to be circulated.

Further, in the ink circulation system 7, the first level sensor 713 is used for management of the quantity of ink stored in the first tank 71. The second level sensor 725 is also used for management of the quantity of ink stored in the second tank 72. Ink may be over-consumed for execution of continued prints. If the quantity of ink stored in the first tank 71 or the second tank 72 is reduced under a criterion to be met, the control section 6 operates the supplemental flow control valve 722 to open to supplement ink from the inkbottle 73 through the ink supplement line 706 to the second tank 72.

[Configuration of the Ink Temperature Control System]

Figure 3:
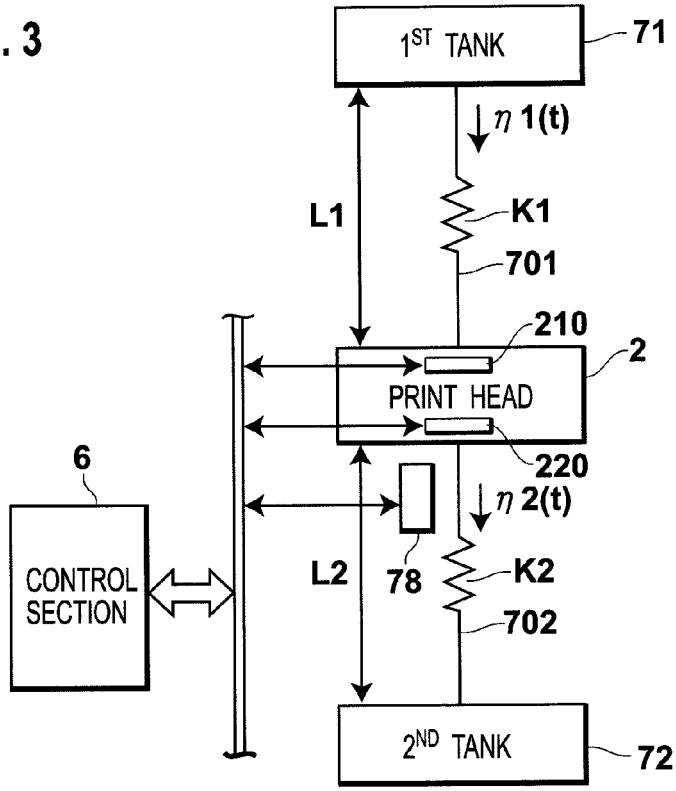
FIG. 3 is a model configuration diagram of an ink temperature control mechanism (as an ink temperature controller) incorporated in the ink circulation system shown in FIG. 2.

According to the first embodiment, the ink circulation system 7 has an ink temperature control system. As shown in FIG. 2 and FIG. 3, the ink temperature control system is configured with the control section 6, and a set of line elements of the ink circulation line 700. The set of line elements includes the thermometer 210, the thermometer 220, and the second heater 78. The thermometer 210 is installed on the side of the ink supply line 701 of the ink circulation line 700, more specifically at the ink distributor 21. The thermometer 220 is installed on the side of the first ink return line 702 of the ink circulation line 700, more specifically at the ink collector 22. The second heater 78 is installed along the first ink return line 702. The control section 6 is adapted to control the second heater 78 to thereby adjust a temperature of ink flowing in the first ink return line 702, in accordance with ink temperatures measured at the thermometers 210 and 220.

As shown in FIG. 3, thermometers 210 and 220 of the ink temperature control system are furnished to the array of print heads 2. The thermometer 210 is adapted to measure a temperature of ink just before the use of ink for a printing at the array of print heads 2. The thermometer 220 is adapted to measure a temperature of surplus ink just after the use of ink for a printing at the array of print heads 2.

In FIG. 3, the reference sign L1 denotes a flow passage length along an ink supply line between the first tank 71 and the array of print heads 2. $\eta 1(t)$ denotes a viscosity of ink in the ink supply line. K1 denotes a fluid resistance coefficient of the ink supply line. Here the ink supply line is assumed to be the ink supply line 701. The ink supply line 701 is construed as including distribution channels in the ink distributor 21.

Further, in FIG. 3, L2 denotes a flow passage length along an ink return line between the array of print heads 2 and the second tank 72. $\eta 2(t)$ denotes a viscosity of ink in the ink return line. K2 denotes a fluid resistance coefficient of the ink return line. Here the ink return line is assumed to be the first ink return line 702. The first ink return line 702 is construed as including collection channels in the ink collector 22. It is noted that in the ink circulation system 7 according to the first embodiment, the flow rate of ink in the first ink return line 702 is very small. In other words, the flow rate of ink in the first ink return line 702 is significantly small when compared with the ink flow rates in the second ink return line 703 and the ink supply line 701. Therefore, the temperature of ink in the first ink return line 702 can be adjusted fast with ease by using the second heater 78. In FIG. 3, the return line is assumed as extending between the array of print heads 2 and the second tank 72. However, there may be system configurations excluding the second tank 72 or the like, so that the second ink return line 703 may have a significant reduced flow rate in comparison with the ink supply line 701. In such configurations, the return line in FIG. 3 may well involve one part or whole length of the second ink return line 703, covering line elements between the array of print heads 2 and the ink circulation pump 75, or between the array of print heads 2 and the first tank 71.

[First Performance of the Ink Temperature Control System: Basic Operation]

In the ink circulation system 7 according to the first embodiment, the ink temperature control system implements a first performance, as follows.

Figure 4:
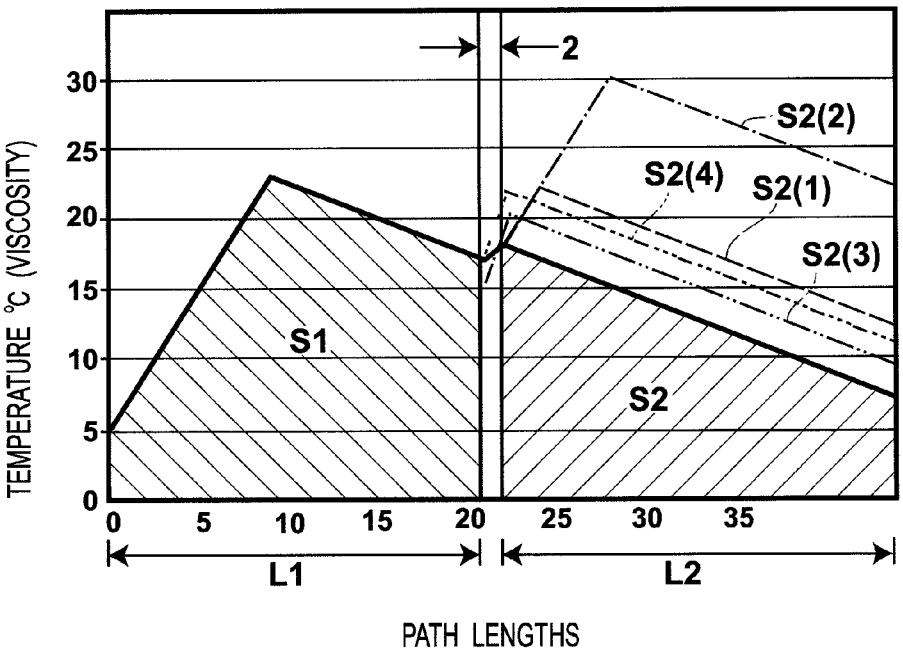
FIG. 4 is a graph showing pressure losses of an ink supply line and an ink return line in the ink circulation system according to the first embodiment.

FIG. 4 shows pressure losses of ink flowing in the ink supply line and the ink return line in FIG. 3 about the array of print heads 2 in the ink circulation line 700. In FIG. 4, the horizontal axis represents a flow passage length L1 along the ink supply line in FIG. 3 assumed as including the ink supply line 701, and a flow passage length L2 along the ink return line in FIG. 3 assumed as including the first ink return line 702. The vertical axis represents viscosities $\eta$ of ink in terms of temperature.

In FIG. 3, ink flows in the ink supply line, and has a pressure representative of a first product ($L1 \times \eta 1(t) \times K1$) of factors including a flow passage length L1 along the ink supply line, a viscosity $\eta 1(t)$ of ink in the ink supply line, and a fluid resistance coefficient K1 of the ink supply line. The first product corresponds to the area of a hatched region S1 in FIG. 4. Further, in FIG. 3, ink flows in the ink return line, and has a pressure representative of a second product ($L2 \times \eta 2(t) \times K2$) of factors including a flow passage length L2 along the ink return line, a viscosity $\eta 2(t)$ of ink in the ink return line, and a fluid resistance coefficient K2 of the ink return line. The second product corresponds to the area of a hatched region S2 in FIG. 4.

In FIG. 3, the ink supply line has ink flowing therein, and the ink return line has ink flowing therein, with the array of print heads 2 intervening as a boundary in between. Ink in the ink supply line has an ink temperature, and ink in the ink return line has another ink temperature. For a type of ink used, in particular for a high-viscous ink, the ink temperature at the ink supply line and the ink temperature at the ink return line tend to get different in between. In such a situation, there is a difference in ink viscosity developed between a state of ink immediately before being supplied to the array of print heads 2 and a state of ink immediately after being collected from the array of print heads 2. Such a difference in ink viscosity is observed in the form of a variation in pressure. As a result, at the array of print heads 2, ink discharge nozzles may have large ink supply pressures exerted thereon. In such a case, there occurs ink leakage with increased useless ink consumption. Instead, at the array of print heads 2, ink discharge nozzles may have small ink supply pressures exerted thereon. In such a case, there occurs inclusion of air bubbles in ink, causing failures in ink discharge, with a degraded print image quality.

As shown in FIG. 2 and FIG. 3, the ink temperature control system according to the first embodiment uses the thermometer 210 for measuring an ink temperature T1 of the ink supply line, and the thermometer 220 for measuring an ink temperature T2 of the ink return line. The control section 6 drives the second heater 78 in accordance with results of the measurements, to increase the ink temperature T2 of the ink return line, thereby increasing the viscosity of ink in the ink return line. As shown in FIG. 4, the ink temperature control system controls the pressure of ink in the ink return line (as the area of a region) designated at reference sign S2(1) to make coincident with the pressure of ink in the ink supply line (as the area of the region S1). That is, $(L1 \times \eta 1(t) \times K1) = (L2 \times \eta 2(t) \times K2)$. This condition has no differences occurring between variable pressures of ink before and after the array of print heads 2, so that it can solve the failures above.

[Second Performance of the Ink Temperature Control System: for Oily Ink]

In the ink circulation system 7 according to the first embodiment, the ink temperature control system implements a second performance for use of an oily ink to be circulated, as follows.

The oily ink is an oil-based ink. The oily ink has small interactions between molecules, and has low surface tensions. The oily ink has a good wettability to line members, elements, media, or the like constituting the ink circulation line 700, and has a property constituting a difficulty of producing air bubbles. There is no need to add surfactants, either.

Here the ink circulation system 7 circulates the oily ink, making use of the property constituting the difficulty of producing air bubbles. In this case, in FIG. 4, the ink temperature control system controls the pressure of oily ink in the ink return line (as the area of a region) designated at reference sign S2(2) to make equal to or larger than the pressure of oily ink in the ink supply line (as the area of the region S1). That is, $(L1 \times \eta 1(t) \times K1) \leq (L2 \times \eta 2(t) \times K2)$. In other words, the ink temperature control system shifts the pressure of oily ink in the ink return line in the direction in which air bubbles have increased tendencies to mix in oily ink at ink discharge nozzles of the array of print heads 2. This condition permits preventing ink leakage at ink discharge nozzles. As described, the oily ink has decreased tendencies to produce air bubbles. Further, air bubbles mixed in oily ink can be removed during circulation of the oily ink. It is noted that the pressure difference to be produced between fluxes of ink in the ink supply line and the ink return line is preset within a range unable to break meniscus.

[Third Performance of the Ink Temperature Control System: for Aqueous Ink]

In the ink circulation system 7 according to the first embodiment, the ink temperature control system implements a third performance for use of an aqueous ink to be circulated, as follows.

The aqueous ink is a water-based ink. The aqueous ink has high surface tensions. The aqueous ink is not good at the wettability to line members, elements, media, or the like constituting the ink circulation line 700. Therefore the aqueous ink has surfactants mixed therein to reduce surface tensions. In this state, the aqueous ink has interfacial surfaces produced between gas and liquid phases, and the surfactants are quickly oriented along the gas/liquid interfacial surfaces in a stabilized manner. On the other hand, the aqueous ink has a property of tending to produce air bubbles.

Here the ink circulation system 7 circulates the aqueous ink, making use of the property of tending to produce air bubbles. In this case, in FIG. 4, the ink temperature control system controls the pressure of aqueous ink in the ink return line (as the area of a region) designated at reference sign S2(3) to make equal to or smaller than the pressure of aqueous ink in the ink supply line (as the area of the region S1). That is, $(L1\times\eta1(t)\times K1)\geq(L2\times\eta2(t)\times K2)$. In other words, the ink temperature control system shifts the pressure of aqueous ink in the ink return line in the direction in which the aqueous ink has increased tendencies to leak at ink discharge nozzles of the array of print heads 2. However, this condition permits preventing inclusion of air bubbles at ink discharge nozzles.

There is an emulsion type of ink prepared as a mixture of an oily ink and an aqueous ink. This type of ink has surfactants mixed therein. For this type of ink, the ink temperature control system implements the third performance.

[First Modification]

According to a first modification of the first embodiment, an inkjet image forming apparatus 10 has an ink circulation system 7 including an ink temperature control system in which the ink return line in FIG. 4 has an ink temperature T2 adjusted by precursor operations at print heads 2, as illustrated by a region S2(4). This adjustment may be made in addition to (or instead of) using a second heater 78 shown in FIG. 2 and FIG. 3. The term precursor operation means an operation of driving a set of (non-depicted) piezoelectric elements in a print head 2 by using waveforms that will not cause ink droplets to be propelled out. This operation produces heat, and produced heat is used to control an ink temperature T2. In FIG. 4, such a control is made to equalize the pressure of ink in the ink supply line and the pressure of ink in the ink return line to each other.

The ink temperature control system can employ both the second heater 78 and precursor operations at print heads 2, to enable quick adjustment of the ink temperature T2. Also, it can simply employ precursor operations at print heads 2, omitting the second heater 78.

[Second Modification]

According to a second modification of the first embodiment, an inkjet image forming apparatus 10 has an ink circulation system 7 including an ink pressure control system in addition to (or instead of) the above-noted ink temperature control system. The ink pressure control system is adapted to control the pressure of ink flowing in an ink return line by using a pressure controller 74 shown in FIG. 2 and FIG. 5. The ink pressure control system is configured with a control section 6, and a set of line elements of an ink circulation line 700. The set of line elements includes a thermometer 210, a thermometer 220, and the pressure controller 74. The thermometer 210 is installed on the side of an ink supply line 701 of the ink circulation line 700, more specifically at an ink distributor 21. The thermometer 220 is installed on the side of a first ink return line 702 of the ink circulation line 700, more specifically at an ink collector 22. The pressure controller 74 is operatively connected through a second tank 72 to the first ink return line 702. As the pressure controller 74, an existing one in the ink circulation system 7 is employed. The control section 6 is adapted to control the pressure controller 74 to thereby adjust a pressure of ink flowing in the first ink return line 702, in accordance with ink temperatures measured at the thermometers 210 and 220.

Figure 5:
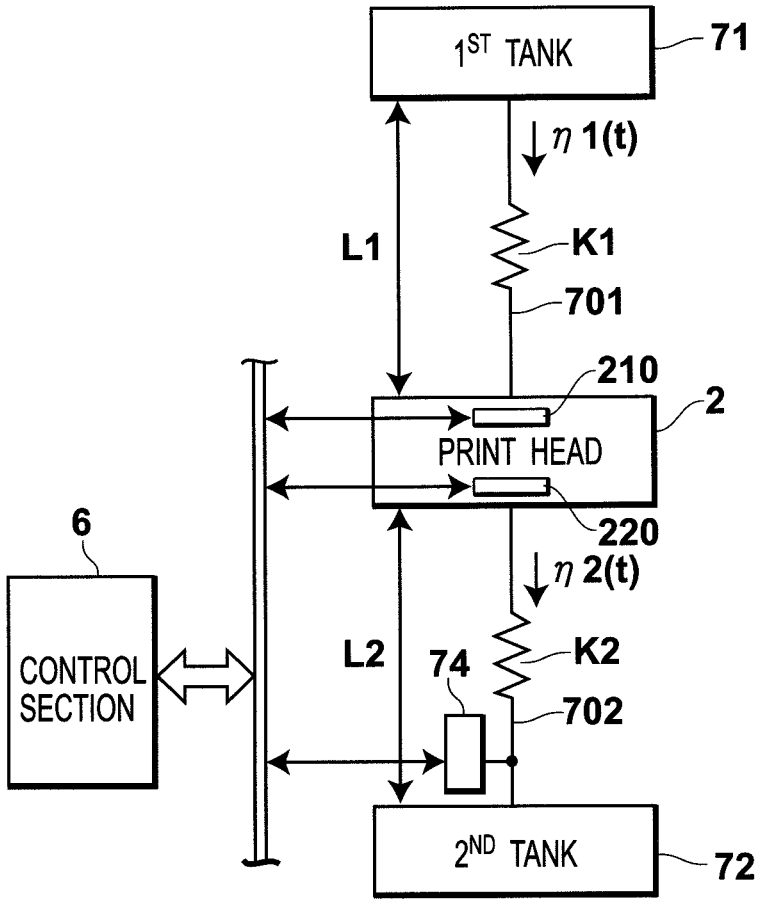
FIG. 5 is a model configuration diagram of an ink temperature control mechanism (as an ink temperature controller) incorporated in an ink circulation system according to a second modification of the first embodiment.

In the ink pressure control system according to the second modification, as shown in FIG. 5, the thermometer 210 is used to measure a temperature T1 of ink flowing in an ink supply line. The thermometer 220 is used to measure a temperature T2 of ink flowing in an ink return line. The control section 6 calculates fluid resistances of the ink supply line and the ink return line depending on results of the measurements, and drives the pressure controller 74 in accordance with results of the calculation, to adjust a pressure (as an area S2) of ink in the ink return line. This adjustment is made in accordance with the type of ink, like the first to third performance in the above-described ink temperature control systems.

[Third Modification]

According to a third modification of the first embodiment, an inkjet image forming apparatus 10 has an ink circulation system 7 including an ink temperature control system. This ink temperature control system is configured with a first heater 76 or a cooler 77 shown in FIG. 2, as it is employed in addition to (or instead of) a second heater 78 shown in FIG. 2. In other words, the ink temperature control system is adapted to make a temperature control of an ink temperature T1 at the side of an ink supply line, to implement a relative pressure control.

[Characteristics of the First Embodiment]

As will be seen from the foregoing description, according to the first embodiment, there is provided an inkjet image forming apparatus 10 employing an ink circulation system including an ink temperature control system. The inkjet image forming apparatus is adapted to suppress ink leakage, reduce useless ink consumption, and suppress air suction, to enhance the print image quality.

Second Embodiment

Description is now made of a second embodiment of the present invention, as an example of the invention applied to an inkjet image forming apparatus employing an ink circulation system. If the system is left uncontrolled without operation for a long while, ink discharge nozzles of an array of print heads 2 may experience evaporation of ink solvent, dispersion medium or the like. Such a situation increases the viscosity of ink, causing the ink to be solidified as the viscosity is increased. Such a state results in a non-conforming discharge of ink, failed discharge, or the like. The second embodiment is adapted to prevent such defects.

[Configuration of the Ink Circulation System]

Figure 6:
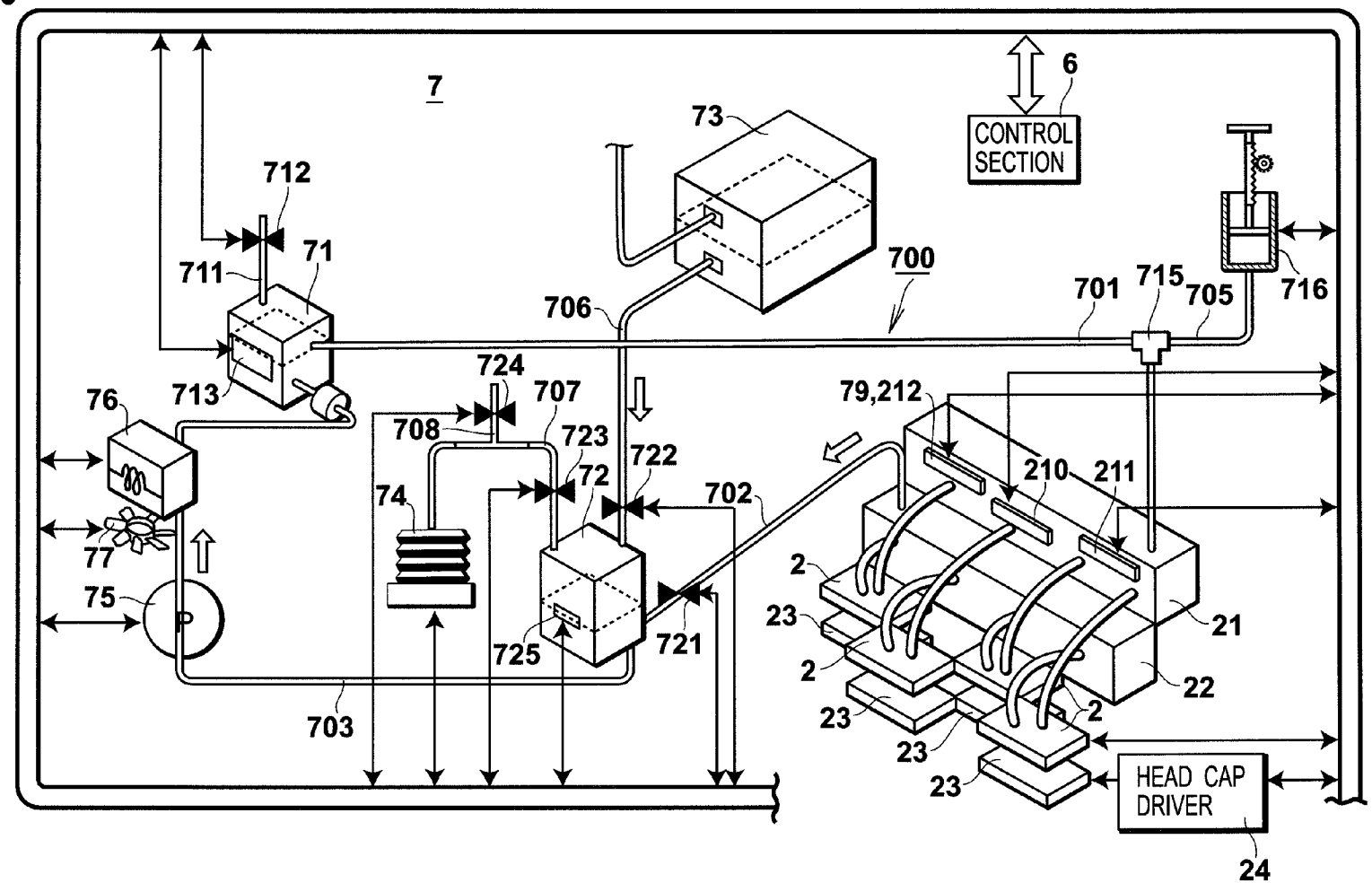
FIG. 6 is a configuration diagram of an ink circulation system of an inkjet image forming apparatus according to a second embodiment of the present invention.

FIG. 6 shows an ink circulation system 7 employed in an inkjet image forming apparatus 10 according to the second embodiment. The ink circulation system 7 is similar in basic configuration to the ink circulation system 7 in the inkjet image forming apparatus 10 according to the first embodiment. However, it has an ink circulation line 700 additionally including a main purge line 705, a line selector 715, a pressurizer 716, a third heater 79, a viscometer (as a viscosity detecting sensor) 211, and a fourth heater 212. The main purge line 705 is branched from an ink supply line 701 of the ink circulation line 700 at a location between two ends of the ink supply line 701, and connected thereto. The line selector 715 is installed between the ink supply line 701 and one end of the main purge line 705. The pressurizer 716 is operatively connected to the other end of the main purge line 705. The third heater 79 is provided at least along the main purge line 705. The viscometer 211 is installed in combination with a thermometer 210, at an ink distributor 12 constituting the ink supply line. The fourth heater 212 is installed at the ink distributor 21 in combination with the thermometer 210 and the viscometer 211.

It is noted that the ink circulation system 7 according to the second embodiment has the first heater 76 and the cooler 77 in the ink circulation system 7 according to the first embodiment. The first heater 76 and the cooler 77 are installed on a second ink return line 703, between an ink circulation pump 75 and a first tank 71. It is also noted that the second heater 78 in the ink circulation system 7 according to the first embodiment is not provided in the ink circulation system 7 according to the second embodiment.

In the ink circulation system 7 according to the second embodiment, a three-way valve is employed as the line selector 715. The line selector 715 makes a switching between two routes being an ink supply route and an ink purge route. The ink supply route is selective to supply ink from the first tank 71, through the ink supply line 701, to the array of print heads 2. The ink purge route is selective to exert pressures from the pressurizer 716, through the main purge line 705 and an associated part of the ink supply line 701, on viscosity-increased fluxes or solidified pieces of ink, to waste them out at print head 2 ends. The line selector 715 is connected through a signal line to a control section 6, which is adapted to control the switching at the line selector 715.

Here, the pressurizer 716 is composed of a cylinder, a piston slidable in the cylinder, a rack and pinion mechanism, and a non-depicted drive source. The drive source drives the rack and pinion mechanism. The rack and pinion mechanism actuates the piston to slide. The drive source used may be a motor drive source, a pneumatic drive source, a hydraulic drive source, or an electromagnetic drive source. The pressurizer 716 is adapted for a service through the ink purge route to mechanically break viscosity-increased fluxes or solidified pieces of ink, to force them out. The pressurizer 716 is controlled for operation from the control section 6.

The third heater 79 is adapted to heat a substantial part of the ink purge route, to enable circulating or breaking and wasting out viscosity-increased fluxes or solidified pieces of ink. The third heater 79 is controlled by the control section 6, to make a temperature control. The fourth heater 212 is adapted to heat interior spaces of the ink distributor 21 and the array of print heads 2, to enable circulating or breaking and wasting out viscosity-increased fluxes or solidified pieces of ink. The fourth heater 212 is controlled by the control section 6, to make a temperature control.

The viscometer 211 is adapted to measure a viscosity of ink to be supplied to the array of print heads 2. It has a result of measurement, which is transmitted to the control section 6.

[System Configuration of the Control Section]

Figure 7:
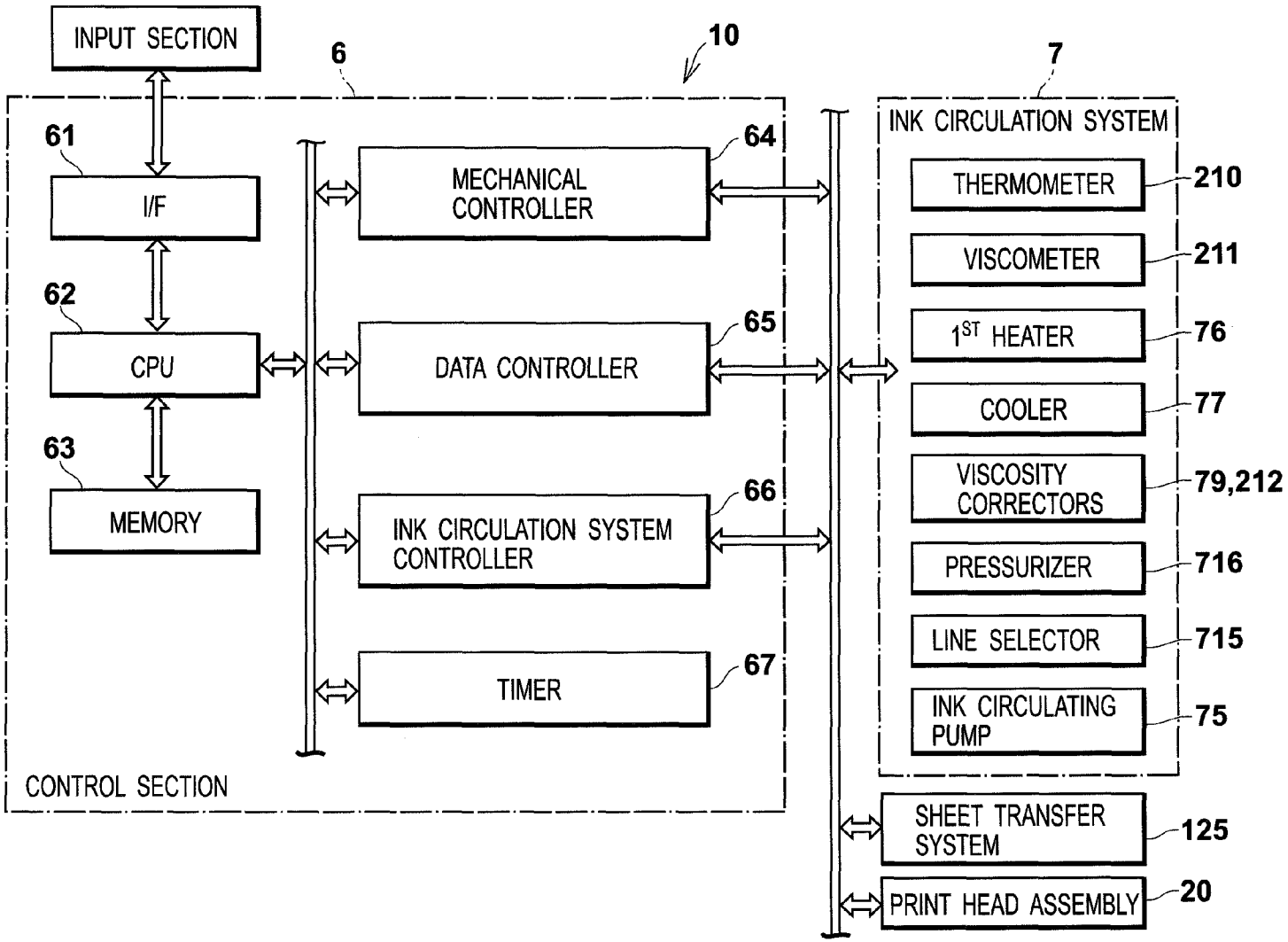
FIG. 7 is a block diagram of a control section and the ink circulation system of the inkjet image forming apparatus according to the second embodiment.

FIG. 7 shows a system configuration of the control section 6 in the inkjet image forming apparatus 10 according to the second embodiment. The control section 6 includes an interface unit (I/F) 61, a central processing unit (CPU) 62, a memory 63, a mechanical controller 64, a data controller 65, an ink circulation system controller 66, and a timer 67. They are mutually connected through an internal bus network given no specific reference signs.

The interface unit 61 is connected to an input/output section, to make transmission and reception of image data, control data, and the like through the section. The input/output section is configured as a set of slots or the like to accommodate connections to an operation section (for instance, a touch panel), external terminals (for instance, personal computers), and removable memories. The operation section is furnished on the inkjet image forming apparatus 10. The external terminals may be connected through a wired LAN or a wireless LAN. The removable memories may include a USB memory, and a card type memory.

The central processing unit 62 is adapted to process data, and control associated devices and line elements, in accordance with programs stored in the memory 63. The data processed may be image data stored in the memory 63, image data from the interface unit 61, or control data.

The mechanical controller 64 controls the sheet transfer system 125 (see FIG. 1). The data controller 65 is connected to the print head assembly 20. The data controller 65 converts image data into print data, and depend thereon to propel out ink droplets at ink discharge nozzles of the array of print heads 2.

The ink circulation system controller 66 governs controlling the ink circulation system 7. In the ink circulation system 7, elements to be controlled include the first heater 76, the cooler 77, viscosity correctors (including the third heater 79 and the fourth heater 212), the pressurizer 716, the line selector 715, and the ink circulation pump 75.

The timer 67 is used for measurement of periods in which the inkjet image forming apparatus 10 is put out of service, and judgment of ink viscosity increase and solidification.

It is noted that the control section 6 is connected to the sheet transfer system 125, the print head assembly 20, and the ink circulation system 7 through an external bus network given no specific reference signs.

[Operations of the Ink Circulation System]

Figure 8:
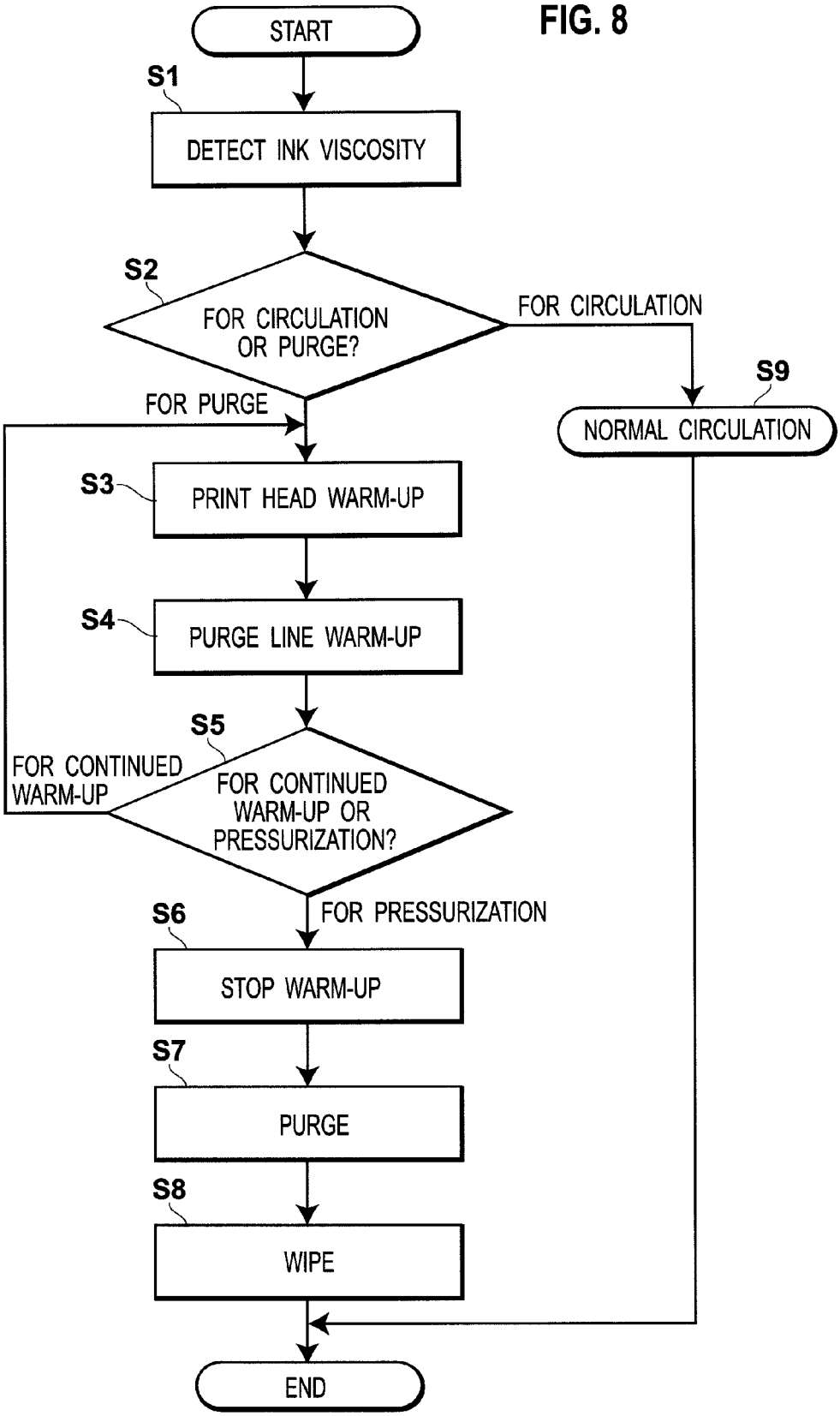
FIG. 8 is a flowchart describing operations of the ink circulation system of the inkjet image forming apparatus according to the second embodiment.

The ink circulation system 7 according to the second embodiment is operable as follows. As shown in FIG. 8, first, the inkjet image forming apparatus 10 is powered on. Then, at step S1, a viscosity of ink is measured by using the viscometer 211 installed on the ink distributor 21 in the ink circulation system 7 shown in FIG. 6. Concurrently, a temperature of ink is measured by using the thermometer 210 installed on the ink distributor 21. Their information is output to the control section 6. Further, the timer 67 of the control section 6 shown in FIG. 7 operates to measure an outage time of the inkjet image forming apparatus 10 (or of the ink circulation system 7).

At a step S2, a determination is made to enter a purge or circulation of ink in the ink circulation system 7, whichever is selective. This selection is based on information on ink viscosity and temperature, and outage time, and a determination table 1 in FIG. 10A, as it is stored in advance in the memory 63.

Figure 9:
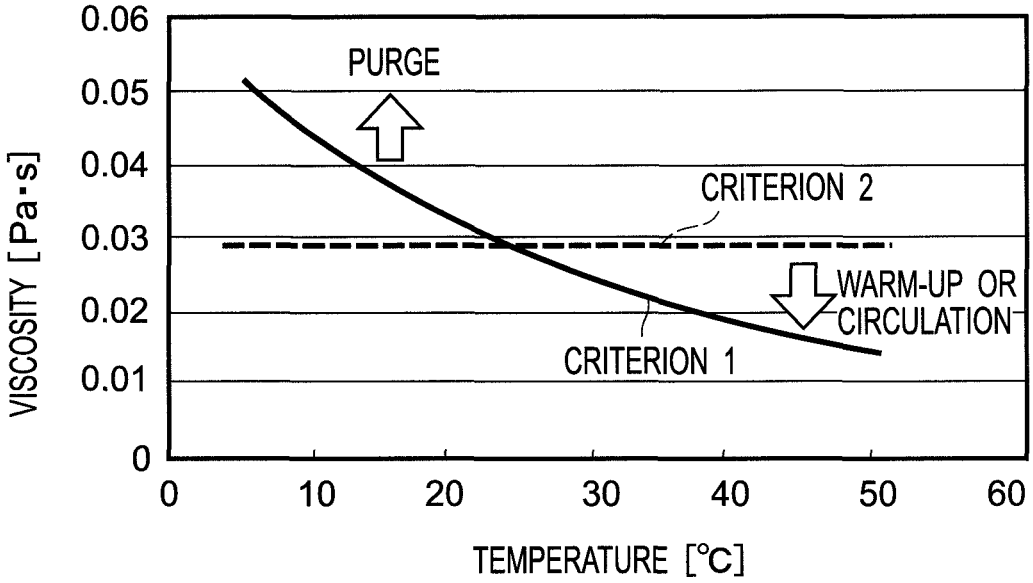
FIG. 9 is a graph showing a relation between ink temperature and viscosity in the inkjet image forming apparatus according to the second embodiment.

FIG. 9 shows a relationship between ink viscosity and temperature, to be used to derive a threshold as necessary to determine a purge or circulation of ink, whichever is selective. In FIG. 9, the horizontal axis represents a temperature (° C.), and the vertical axis represents a viscosity (Pa·s). A criterion 1 is prepared as a threshold to determine a purge to be selected or not to circulate or break and waste viscosity-increased fluxes or solidified pieces of ink. For states of ink equal to or higher than the criterion 1, the purge is set as a basic operation to be executed. A criterion 2 is prepared as a threshold that permits breaking and wasting out fluxes of ink at ink discharge nozzles of the array of print heads 2. This can be made by physically pressurizing the ink purge route, even for viscosity-increased fluxes or solidified pieces of ink. For states of ink equal to or lower than the criterion 2, the ink purge route is physically pressurized, and the purge is executed to break and waste out viscosity-increased fluxes or solidified pieces of ink. The first embodiment permits a physical pressurization to be made to thereby break and waste out ink residing within a region between the criteria 1 and 2. That is within a region of ink states equal to or smaller than the criterion 2 (a region of approximately 25° C. or more and 30 mPa·s or less) and equal to or higher than the criterion 1. Ink may have states within a region of ink states equal to or higher than the criterion 1, residing within a region of ink states equal to or higher than the criterion 2 (a region of approximately 25° C. or less and 30 mPa·s or more). For such states of ink, it is difficult to use a physical pressurization for breaking and wasting out ink. Therefore, for such states of ink, the array of print heads 2 and the ink purge route are warmed up, or ink is circulated to moderate viscosity increase or solidification, to make viscosity correction within a region of ink states equal to or lower than the criterion 2.

The determination table 1 shown in FIG. 10A is a listing of stored data to determine a purge or ink circulation, whichever is selective to execute in accordance with a combination of ink viscosity and temperature, and outage time. For instance, ink circulation (round ○ mark) is to be made if the ink temperature is 18° C., and the ink viscosity is 30 mPa·s, for outage times of the inkjet image forming apparatus under 336 hours (two weeks). Or, a purge (rectangular ▲ mark) is to be made if the ink temperature is 18° C., and the ink viscosity is 35 mPa·s, for outage times of the inkjet image forming apparatus under 336 hours (two weeks). For outage times of the inkjet image forming apparatus equal to or longer than 336 hours, a purge (rectangular ▲ mark) is to be made irrespective of values of ink temperature and viscosity.

At the step S2, if it is determined that no ink is viscosity-increased or solidified, the control flow goes to a step S9, where the ink circulation system 7 performs usual ink circulation, in which ink is circulated along the ink circulation line 700.

The inkjet image forming apparatus 10 may be left uncontrolled for a long while, and have an increased viscosity of ink. In such a situation, if it is determined at the step S2 that ink is viscosity-increased or solidified, the mechanical controller 64 of the control section 6 shown in FIG. 7 controls the line selector 715 shown in FIG. 6 and FIG. 7, to switch the ink supply route to the ink purge route. That is, the line selector 715 is operated to cut the ink supply line in the way, and interconnect the main purge line 705 with a cut-off section of the ink supply line 701. The ink purge route is thereby established to interconnect the pressurizer 716 and the array of print heads 2 with each other. Then, at steps S3 and S4, ink is warmed up in the array of print heads 2 and the ink purge route. Those warm-up steps employ the fourth heater 212 and the third heater 79 in order. The fourth heater 212 constitutes a viscosity corrector installed on the ink distributor 21. The third heater 79 constitutes a viscosity corrector provided along the ink purge route. The viscosity correctors are controlled by the ink circulation controller 66 in the control section 6. At this time, precursor operations may be made at print beads 2 to warm up ink in vicinities of ink discharge nozzles. The warm-up can moderate viscosity increase or solidification of ink in print heads 2 as well as in the ink purge route.

Next, in the ink circulation system 7, the viscometer 211 is used to again measure a viscosity of ink, and the thermometer 210 is used to again measure a temperature of ink. Then, at a step S5, the control section 6 determines using the viscosity correctors for a continued warm-up of ink or using the pressurizer 716 for pressurization, whichever is selective to execute in accordance with results of the above measurements. For the determination, the control section 6 employs a determination table 2 shown in FIG. 10B, as it is stored in advance in the memory 63.

The determination table 2 shown in FIG. 10B is a listing of stored data to determine continuing warm-up of ink or using the pressurizer 716 for pressurization, whichever is selective to execute against a given combination of ink viscosity and temperature. In the second embodiment, a purge (rectangular ▲ mark) is to be made if the ink viscosity is 30 mPa·s or less, irrespective of the ink temperature. If the ink viscosity exceeds 30 mPa·s, a continued purge (star ☆ mark) is to be made irrespective of the ink temperature.

If continuing warm-up of ink is determined to execute, the control flow again goes to the step S3. If pressurization is determined to execute, the control flow goes to a step S6, where the control section 6 stops operating the viscosity correctors, i.e., interrupts using the third heater 79 and the fourth heater 212 for warm-up. Then, at a subsequent step S7, the ink circulation system controller 66 in the control section 6 drives the pressurizer 716 to make purge. In the purge, the ink purge route is pressurized to forcibly (physically) break and waste out viscosity-increased fluxes or solidified pieces of ink at ink discharge nozzles in the array of print heads 2.

After completion of purge, the control flow goes to a step S8, where a non-depicted maintenance unit is used to execute a wipe cleaning of ink discharge nozzles at the array of print heads 2.

[Characteristics of the Second Embodiment]

As will be seen from the foregoing description, according to the second embodiment, there is provided an inkjet image forming apparatus 10 employing an ink circulation system 7. The ink circulation system 7 includes the line selector 15, the main purge line 705, the pressurizer 716, the viscosity correctors, the thermometer 210, the viscometer 211, and the control section 6 controlling them. The inkjet image forming apparatus 10 is adapted to surely break and waste out unnecessary viscosity-increased fluxes or solidified pieces of ink in vicinities of ink discharge nozzles in the array of print heads 2, and prevent non-conforming discharge of ink, failed discharge, and the like.

Further, the inkjet image forming apparatus 10 including the viscosity correctors has the combination of determination tables 1 and 2 stored in the memory 63 of the control section 6. It permits warming ink to moderate viscosity increase or solidification of the ink up to a state (criterion 2 in FIG. 9) that affords to exert a physical pressurization for breaking and wasting out the ink. The moderation is made before a purge. Therefore, interior spaces of the ink supply line and the array of print heads 2 are kept from experiencing high pressures exerted thereon. Accordingly, line pressures of the ink circulation system 7 can be set low, allowing for saved expenses for line members and print head members, as well as reduced costs for their fabrication. Fabrication costs of the entirety of inkjet image forming apparatus 10 can thus be reduced.

Third Embodiment

Description is now made of a third embodiment of the present invention, as an example of the invention applied to an inkjet image forming apparatus employing an ink circulation system. Like the ink circulation system 7 in the inkjet image forming apparatus 10 according to the first embodiment, differences in viscosity of ink may develop in particular when a high-viscous ink is used. Such viscosity differences of ink may cause ink leakage at an array of print heads 2 or ink overflow at a first tank 71 in the ink circulation system. The third embodiment can prevent such leakage or overflow of ink, permitting ink warm-up to be made in a short time with saved power.

[Configuration of the Ink Circulation System]

The inkjet image forming apparatus 10 according to the third embodiment has an ink circulation system 7 identical in basic configuration to the ink circulation system 7 shown in FIG. 2 or the ink circulation system 7 shown in FIG. 6, and description thereof is omitted. The ink circulation system 7 according to the third embodiment may have a configuration omitting the second heater 78 of the ink circulation system 7 shown in FIG. 2. The ink circulation system 7 according to the third embodiment may have a configuration omitting the line selector 715, the main purge line 705, the pressurizer 716, and the viscosity correctors of the ink circulation system 7 shown in FIG. 6.

[Fluid Passage Configuration of Print Heads]

Figure 11:
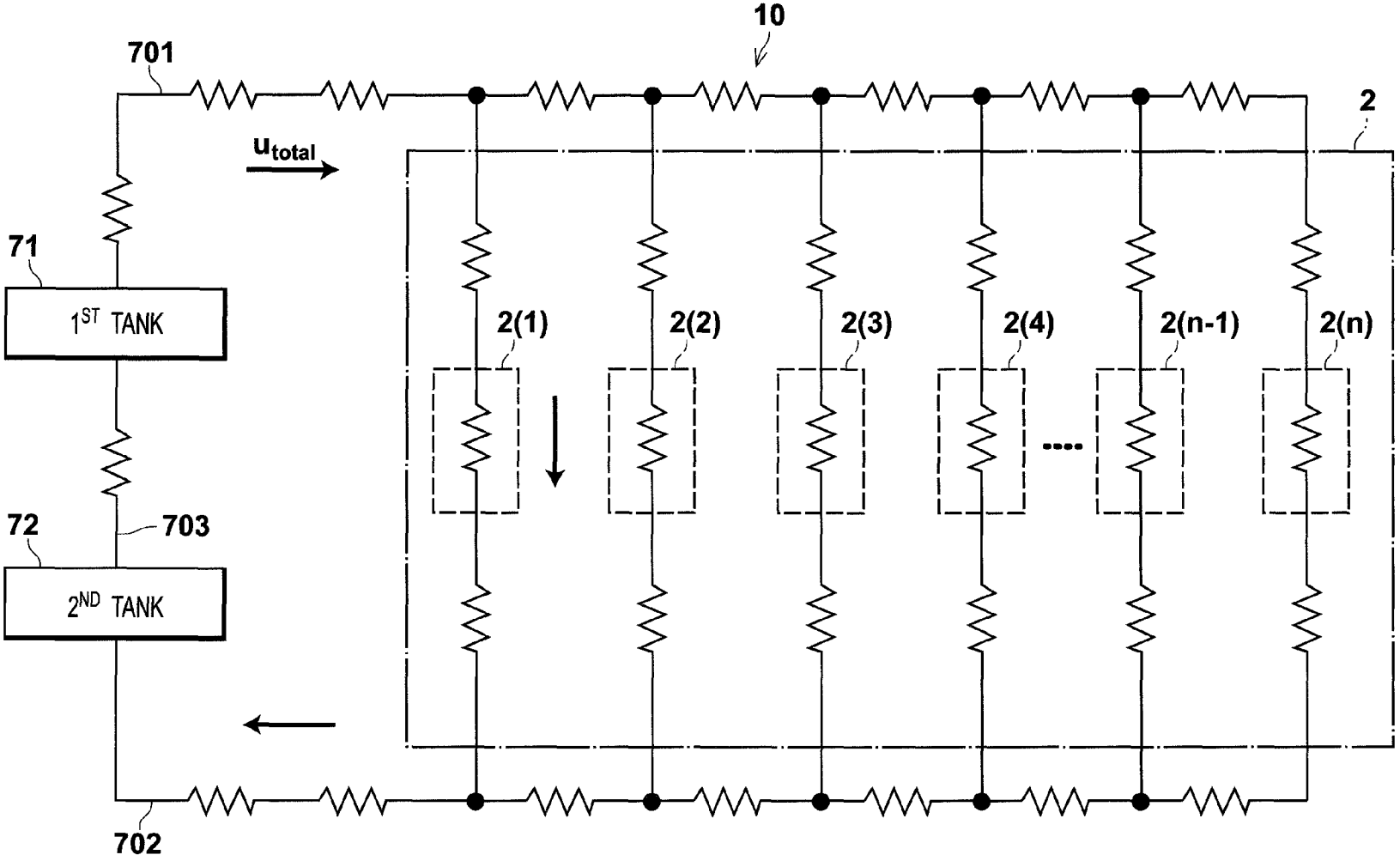
FIG. 11 is a model configuration diagram of an ink circulation system of an inkjet image forming apparatus according to a third embodiment of the present invention.

As schematically shown in the form of a fluid passage model in FIG. 11, the ink circulation system 7 according to the third embodiment has a set of print heads 2(1) to 2(*n*) connected in parallel to each other between an ink supply line 701 and a first ink return line 702. Here, n is an integer of 2 or more. More specifically, the third embodiment has a set of six print heads 2(1) to 2(6) connected in parallel every ink color, though the number of print heads is not limited thereto in any way.

This embodiment also includes an ink distributor 21 shown in FIG. 2 and an ink collector 22 shown in FIG. 6, while they are non-depicted in FIG. 11 for easy understanding.

[Operations of the Ink Circulation System]

Figure 12:
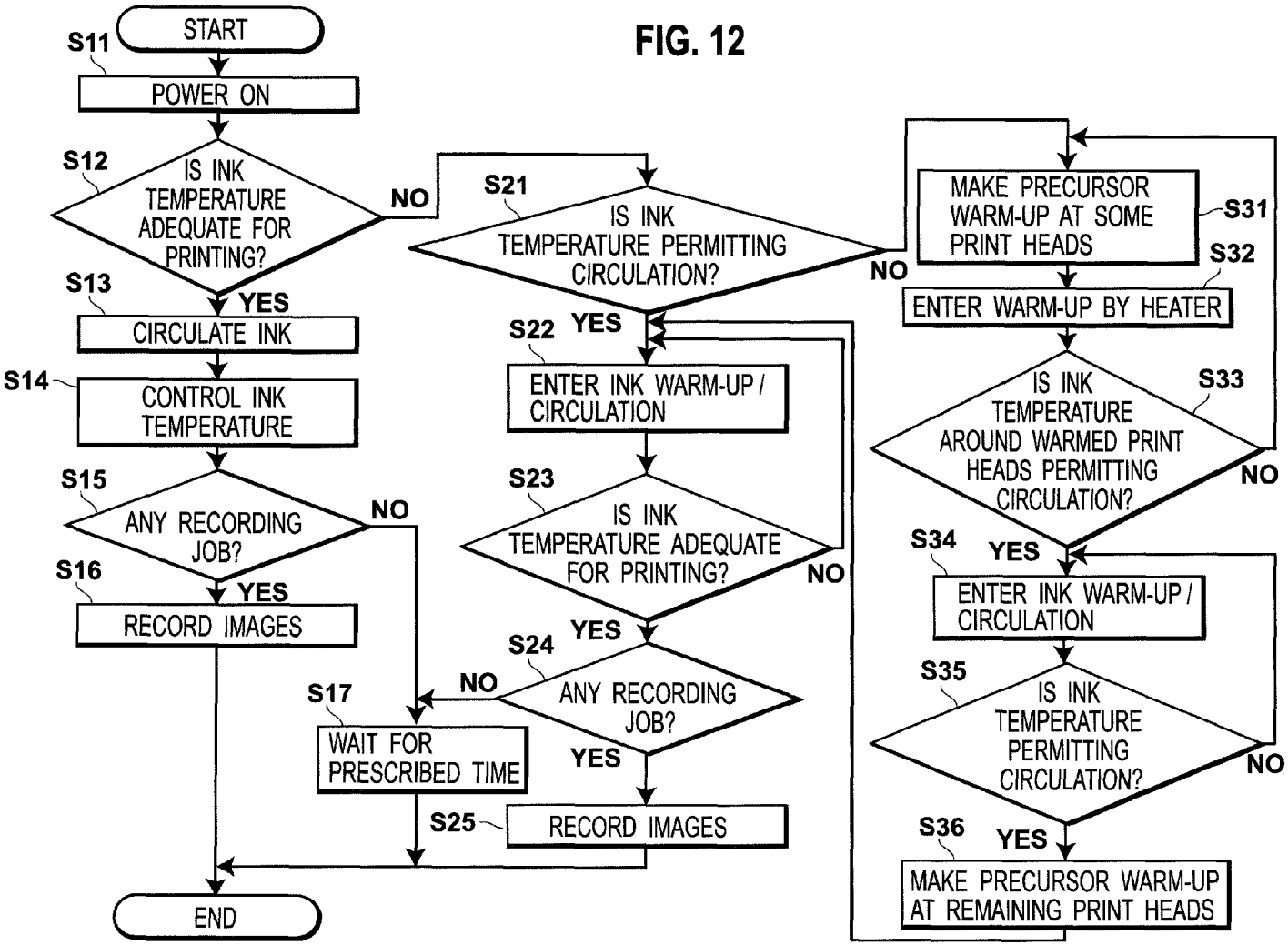
FIG. 12 is a flowchart describing operations of the ink circulation system according to the third embodiment.

The ink circulation system 7 according to the third embodiment is operable as follows. As shown in FIG. 12, at a first step S11, the inkjet image forming apparatus 10 is powered on. Then, for instance, a temperature of ink is measured by using a thermometer 210 installed on the ink distributor 21 in the ink circulation system 7 shown in FIG. 6. This information is output to a control section 6.

At a step S12, the control section 6 determines whether or not the measured ink temperature is adequate for a printing. If the temperature is determined to be adequate for the printing, the control flow goes to a step S13, where ink is circulated along an ink circulation line 700 of the ink circulation system 7. Then, at a step S14, a first heater 76 or a cooler 77 installed on the ink circulation line 700 is used for temperature adjustment of circulating ink. When the ink temperature is low, the first heater 76 is used to warm up ink. When the ink temperature is high, the cooler 77 is used to decrease the temperature of ink. At a subsequent step S15, it is determined if there is any recording job (print data) in the control section 6. If there is any recording job, the control flow goes to a step S16 to execute the printing. If there is no recording job, the control flow goes to a step S17 to enter a waiting mode to be kept for a prescribed time.

At the step S12, if the temperature is determined to be inadequate for the printing, the control flow goes to a step S21. At this step, a temperature of ink circulating in the ink circulation line 700 is measured, and it is determined whether or not the temperature is adequate for circulation. For the measurement of ink temperature, there may be use of a thermometer 220 installed at the ink collector 22 shown in FIG. 2, or any one of non-depicted thermometers installed at various locations on the ink circulation line 700. A measured temperature of ink is output to the control section 6. Ink is circulated by a difference in water head between a first tank (as an upstream tank) 71 and a second tank (as a downstream tank) 72. Circulating ink has a flow rate depending on the water head difference, and the ink temperature. For the circulation to be effective, the flow rate should be greater than required at the array of print heads 2. This condition is met, when an ink temperature is determined to be adequate for circulation.

At the step S21, if the ink temperature is determined to be adequate for circulation, the control flow goes to a step S22 to start circulation of ink. For this circulation of ink, the control section 6 controls line elements of the ink circulation line 700 shown in FIG. 2, as necessary. The line elements include valves (for instance, an open-close valve 721), a pressure controller 74, and an ink circulation pump 75. Concurrently, the control section 6 controls the first heater 76 or the like to thereby adjust the temperature of circulating ink to be optimal for a printing. Then, at a step S23, it is determined whether or not the temperature of circulating ink has reached an optimal temperature for the printing. If the optimal temperature is reached, the control section 6 interrupts circulation of ink, and stops adjusting the temperature of ink. At a subsequent step S24, it is determined if there is any recording job in the control section 6. If there is any recording job, the control flow goes to a step S25 to execute the printing. If there is no recording job, the control flow goes to the step S17 to enter a waiting mode to be kept for a prescribed time.

At the step S21, if the ink temperature is determined to be inadequate for circulation, the control flow goes to a step S31, where the control section 6 controls a subset of the set of print heads 2 shown in FIG. 11 to make precursor operations. Concurrently, at a step S32, the control section 6 controls the first heater 76 or the like installed on the ink circulation line 700 shown in FIG. 2, to thereby adjust the temperature of circulating ink to be optimal for a printing. Here, the subset of the set of print heads 2 indicates at least one print head 2(1) out of two print heads nearest to the ink supply line 701 or the first ink return line 702, in the set of print heads 2(1) to 2(*n*). In the third embodiment, a precursor operation is made at each of two print heads 2(1: a first head) and 2(2: a second head) in the set of print heads 2.

When a precursor operation is made at one print head 2(1), this print head 2(1) is warmed, and the viscosity of ink is decreased. As a result, an ink circulation route including the ink supply line 701, the print head 2(1), and the first ink return line 702 has a reduced fluid resistance. Likewise, when a precursor operation is made at the other print head 2(2), this print head 2(2) is warmed, and the viscosity of ink is decreased. As a result, an ink circulation route including the ink supply line 701, the print head 2(2), and the first ink return line 702 has a reduced fluid resistance.

Figures 13, 14:
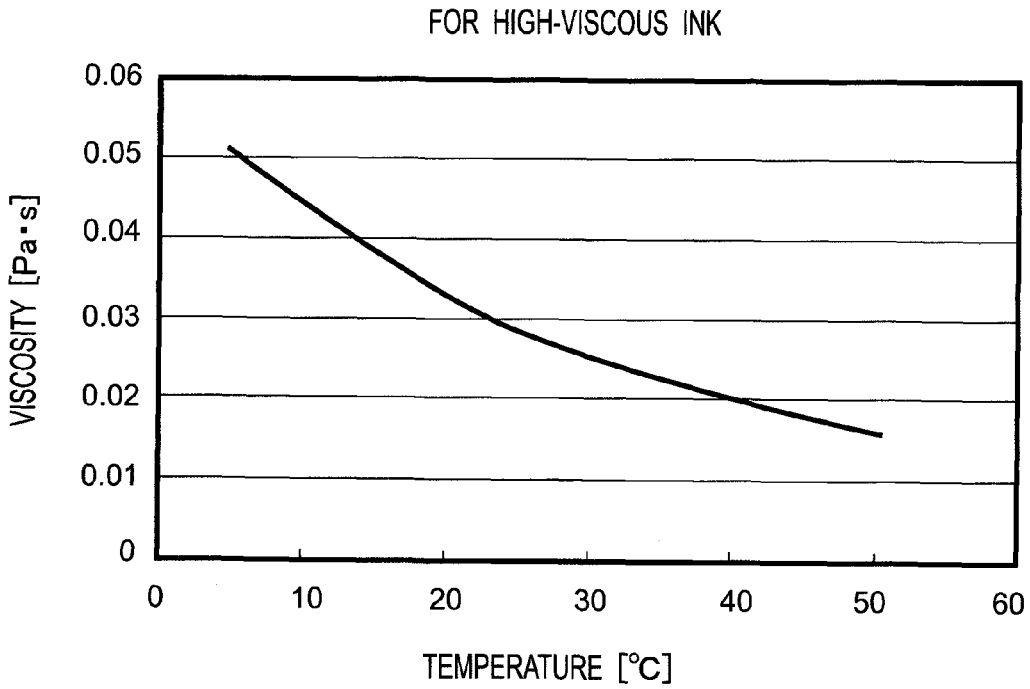
FIG. 13 is a table listing flow rates of ink before and after warm-up at branch lines of the ink circulation system shown in FIG. 11.
FIG. 14 is a graph showing a relation between ink temperature and viscosity in the ink circulation system according to the third embodiment.

FIG. 13 is a table listing flow rates of ink in a circulation route including the set of print heads 2 and each branch route including a print head, at time points before and after precursor operations (before and after warm-up) made at some print heads. The flow rates listed here are results of calculations assuming an ink temperature to be 5° C., and an ink viscosity to be 50 mPa·s, when powered on. The calculations were made of a flow rate $u_{total}$ of ink in the circulation route including the set of print heads 2, and flow rates $u_1$ to $u_6$ of ink in the branch routes including the print heads 2(1) to 2(6), respectively.

The flow rate $u_{total}$ of ink in the circulation route was 58.2 ml/min before the warm-up, but was increased to 71.5 ml/min after the warm-up. The flow rate $u_1$ of ink in the branch route including the print head 2(1) was 11.3 ml/min before the warm-up, but was increased to 17.9 ml/min after the warm-up. Also, the flow rate $u_2$ of ink in the branch route including the print head 2(2) was 10.8 ml/min before the warm-up, but was increased to 17.4 ml/min after the warm-up.

For the print heads 2(3) to 2(6), no precursor operation was made, and they were not substantially affected by temperature variations due to a precursor operation at the nearest print head 2(2). Therefore, the branch route including the print head 2(3), the branch route including the print head 2(4), the branch route including the print head 2(5), and the branch route including the print head 2(6) had flow rates $u_3$, $u_4$, $u_5$, and $u_6$ of ink therein little changed between states before and after the warm-up. The flow rates $u_3$ to $u_6$ were as small as residing within a range of 8.8 ml/min to 9.4 ml/min.

As shown in FIG. 14, the viscosity of ink about the print heads 2(1) and 2(2) went down to 37 mPa·s, as the temperature is raised up to 15° C., for instance. At the branch route including the print head 2(1) and the branch route including the print head 2(2), their fluid resistances were decreased, and ink flow rates $u_1$ and $u_2$ were increased to be approximately 1.7 times as large as they were before the warm-up. As a result, also the flow rate of ink in the ink circulation line 700 was increased. This permits the first heater 76 to serve for warm-up by heat exchange with an increased efficiency. Therefore, the temperature of circulating ink can be raised in a short while with saved power.

The execution of precursor operation is followed by a step S33, where it is determined whether or not a temperature of ink about the print heads 2(1) and 2(2) is adequate for circulation. If the ink temperature is inadequate for circulation, the control flow again goes to the step S31.

If the temperature of ink about the print heads 2(1) and 2(2) is determined to be adequate for circulation, the control flow goes to a step S34, where the control section 6 works to start circulation of ink, and control circulating ink to adjust the ink temperature to be optimal for a printing. For the circulation of ink, the control section 6 controls the pressure controller 74 and the ink circulation pump 75, while operating associated valves and the like. For the adjustment of temperature, the control section 6 controls the first heater 76, etc.

At a subsequent step S35, it is determined whether or not a temperature of ink is adequate for circulation. If the ink temperature is determined to be inadequate for circulation, the control flow again goes to the step S34. If the temperature is determined to be adequate for circulation, the control flow goes to a step S36 to enter precursor operations at another subset of the set of print heads 2, that is, at the print heads 2(3) and 2(4) in this case. As a result, the four print heads 2(1) to 2(4) undergo precursor operations. Afterward, the control flow again goes to the step S22 to execute subsequent processes.

[Characteristics of the Third Embodiment]

Figure 15:
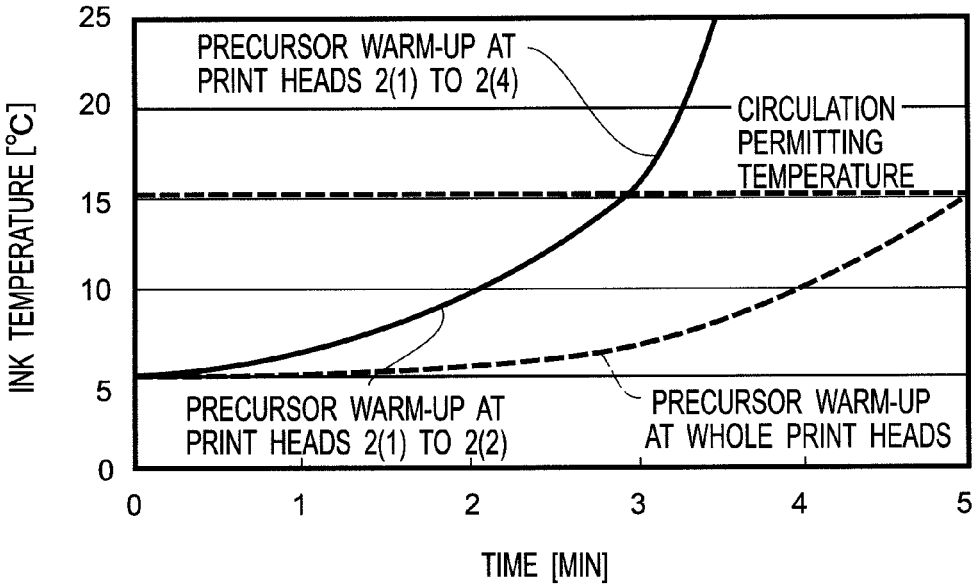
FIG. 15 is a graph showing a relation between lapse of time and temperature of ink in the ink circulation system according to the third embodiment.
Figure 16:
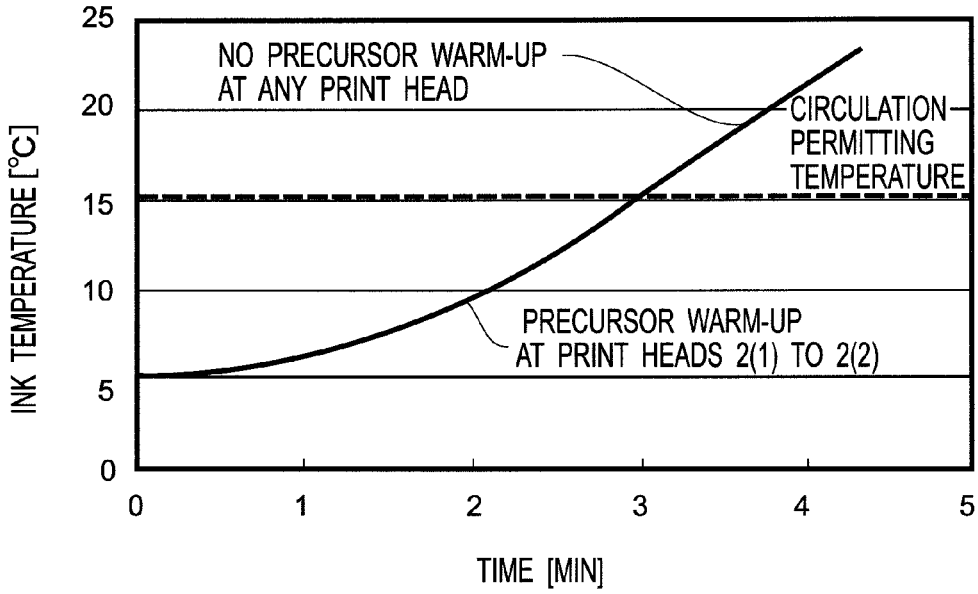
FIG. 16 is a graph showing another relation between lapse of time and temperature of ink in the ink circulation system according to the third embodiment.

FIG. 15 is a graph showing a relation between ink temperatures and warm-up times required to attain an ink temperature admitting circulation. The horizontal axis represents warm-up times (min), and the vertical axis represents ink temperatures (° C.). For an inkjet image forming apparatus 10 according to the third embodiment, a set of print heads 2, i.e., all print heads 2(1) to 2(6) underwent precursor operations to obtain data. In this case, it needed approximately 5 minutes to attain a circulation admitting ink temperature (within a range of 5° C. to 15° C.).

For the inkjet image forming apparatus 10 according to the third embodiment, precursor operations were performed at a subset of the set of print heads 2, i.e., at print heads 2(1) and 2(2). In this case, it took no more than approximately 3 minutes to attain a circulation admitting ink temperature. Hence, the time was contracted. Further, electric power was saved by the precursor operations simply made at the subset being the print heads 2(1) and 2(2).

After the circulation admitting ink temperature was attained, precursor operations were performed at a doubled subset of the set of print heads 2, i.e., at print heads 2(1) to 2(4), successfully raising the ink temperature with an enhanced gradient FIG. 6 shows a case in which the attainment of circulation admitting ink temperature was not followed by precursor operations to be performed at the subset being print heads 2(1) to 2(4). In this case, the ink temperature was raised with a retained gradient not enhanced.

As will be seen from the foregoing description, according to the third embodiment, there is provided an inkjet image forming apparatus 10 adapted to perform precursor operations at a subset of a set of print heads 2, allowing for a warm-up to be executed in a short while with saved power. As a result, the inkjet image forming apparatus is adapted to prevent ink leakage at print heads due to ink viscosity differences, overflow of ink at a first tank 1 in an ink circulation system.

Other Embodiments

Although the present invention has been described by using examples of embodiment, this invention should not be restricted by any phrases or drawings as part of the disclosure. The present invention is applicable to various substitute embodiments, embodiment examples, and application techniques. For instance, the present invention is not limited to color inkjet image forming apparatuses, and is applicable also to monochrome inkjet image forming apparatuses. Further, the present invention is applicable to complex type inkjet image forming apparatuses adapted for scanner functions or facsimile functions.

As will be seen from the foregoing description, according to the present invention, there is provided an inkjet image forming apparatus employing an ink circulation system and wide applicable. The inkjet image forming apparatus is adapted to suppress ink leakage, reduce useless ink consumption, and suppress air suction, to enhance the print image quality.

The present application claims the benefit of priority under 35 U.S.C. §119 to Japanese Patent Application No. 2010-240979, filed on Oct. 27, 2010, the entire content of which is incorporated herein by reference.

What is claimed is:

1. An inkjet image forming apparatus comprising:

an inkjet print head;

an ink tank adapted to store a prescribed type of ink;

an ink circulation line comprising an ink supply line configured to supply ink from the ink tank to the print head and an ink return line configured to return ink from the print head to the ink tank; and a controller configured to adjust a first product of factors including a flow passage length along the ink supply line, a viscosity of ink in the ink supply line, and a fluid resistance coefficient of the ink supply line, and a second product of factors including a flow passage length along the ink return line, a viscosity of ink in the ink return line, and a fluid resistance coefficient of the ink return line, in accordance with the type of ink, to control temperatures of ink in the ink circulation line.

2. The inkjet image forming apparatus according to claim 1, wherein the ink circulation line comprises thermometers configured to measure temperatures of ink therein, and line elements configured to heat or cool ink therein, and the controller is adapted to control the line elements in accordance with measures of the thermometers.

3. The inkjet image forming apparatus according to claim 1, wherein the ink circulation line comprises line elements configured to change pressures of ink therein, and the controller is adapted to control the line elements to adjust a relation between the first product and the second product.

4. The inkjet image forming apparatus according to claim 1, wherein the controller is adapted to adjust a magnitude relation between the first product and the second product.

5. The inkjet image forming apparatus according to claim 1, wherein the type of ink is an oily, and the controller is adapted to make the second product equivalent to or larger than the first product.

6. The inkjet image forming apparatus according to claim 1, wherein the type of ink is an aqueous, and the controller is adapted to make the first product equivalent to or larger than the second product.

7. The inkjet image forming apparatus according to claim 1, wherein the controller is adapted to equalize the first product and the second product with each other.

* * * * *